US008393592B1

(12) United States Patent
Caron

(10) Patent No.: US 8,393,592 B1
(45) Date of Patent: Mar. 12, 2013

(54) OIL AND GAS WELL PAD FOUNDATION FORM SYSTEM

(76) Inventor: Chuck Caron, Rifle, CO (US)

( * ) Notice: Subject to any disclaimer, the term of this patent is extended or adjusted under 35 U.S.C. 154(b) by 219 days.

(21) Appl. No.: 13/033,022

(22) Filed: Feb. 23, 2011

Related U.S. Application Data

(60) Provisional application No. 61/307,096, filed on Feb. 23, 2010.

(51) Int. Cl.
*E04G 15/00* (2006.01)

(52) U.S. Cl. ..... 249/1

(58) Field of Classification Search ..... 249/1, 10, 249/11, 18; 405/222, 223; 166/366
See application file for complete search history.

(56) References Cited

U.S. PATENT DOCUMENTS

| | | | | | |
|---|---|---|---|---|---|
| 3,353,364 | A * | 11/1967 | Blanding et al. | ..... | 405/189 |
| 3,503,443 | A * | 3/1970 | Trageser et al. | ..... | 166/344 |
| 4,054,034 | A * | 10/1977 | Hyre et al. | ..... | 405/223 |
| 4,220,421 | A * | 9/1980 | Thorne | ..... | 405/211 |
| 4,793,418 | A * | 12/1988 | Wheeler et al. | ..... | 166/357 |
| 4,907,914 | A * | 3/1990 | Gunderson et al. | ..... | 405/224 |
| 7,938,190 | B2 * | 5/2011 | Talamo et al. | ..... | 166/358 |

* cited by examiner

*Primary Examiner* — Michael Safavi

(57) ABSTRACT

The oil and gas well pad foundation form system isolates a concrete pour from the well head and provides blockouts for piping installation. The system can be removed after concrete pour and set up and reused countless times. The system is provided in different sizes with blockouts in varying locations as desired. Multiple well heads can be prepared for within a given cellar, simultaneously.

3 Claims, 6 Drawing Sheets

OIL AND GAS WELL PAD FOUNDATION FORM SYSTEM

CROSS-REFERENCE TO RELATED APPLICATIONS

U.S. Provisional Patent Application No. 61/307,096 filed Feb. 23, 2010

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of oil and gas well pad foundations are known in the prior art. As example, previous systems require a 5-foot diameter cellar ring to be set around where the well head will be placed and placement of concrete around the cellar ring, which is typically made from corrugated pipe. After completion of drilling, the cellar ring would be torn out and thrown away in order to access the well head and to hook up piping. What is needed is an oil and gas well pad foundation form system that isolates a concrete pour from the well head and provides blockouts for piping, all of which can be removed after placement of concrete, and then set up and reused many times, as well as a system that is provided in different sizes with blockouts capable of locating as desired.

FIELD OF THE INVENTION

The oil and gas well pad foundation form system relates to oil and gas drilling equipment foundations and more especially to a removable well pad foundation form system.

SUMMARY OF THE INVENTION

The general purpose of the oil and gas well pad foundation form system, described subsequently in greater detail, is to provide a oil and gas well pad foundation form system which has many novel features that result in an improved oil and gas well pad foundation form system which is not anticipated, rendered obvious, suggested, or even implied by prior art, either alone or in combination thereof.

To attain this, the present oil and gas well pad foundation form system may be used on all gas and oil well pad cellars prior to drilling rig operations. An open space below ground level called the cellar is typically 4 to 5 feet in depth. Concrete is not to be poured around where the well head will be placed after drilling is complete nor around areas where additional piping is tied into the underground well. The present form system uses concrete forms that can be removed after placement of the concrete, then again set up and reused many times. The present form system also includes blockouts for piping, which come in different dimensions and can be positioned on the cylinders in different ways to run piping to the well head. Some gas companies drill wells in a quad configuration, in which there are four wells per quad. Thus, if there are 12 quads, 48 wells are set on the 12 quads. The present form system may be set up for wells in the quad configuration as well as for wells which are in a straight line, rather than in a quad configuration. In the present form system, the main concrete form may be 5 feet in diameter at the top, and may have a conical shape wherein the form is slightly smaller at the bottom end for easy removal after concrete pour. The blockouts, which are smaller rectangular forms for piping, are bolted on so that the blockouts can be removed from the cylinders. The blockouts are provided in different sizes and locations, either attached to or separate from the cylinders, which can be disposed according to the user's needs. Lift brackets are ideally disposed on the cylinder perimeter and the blockout inner lips for structural integrity during lifting of the system components. The cylinders and blockouts may also be provided without perimeters and inner lips and with direct lift bracket attachments.

In addition, a new style of drilling rigs employs directional drilling combined with placement of more wells per well pad. Such a practice may for example focus on a quad configuration by which all 4 wells are drilled before moving. The present system therefore far excels over the older more typical drilling efforts using corrugated pipe cellar ring form as discussed above, wherein one well was drilled, then the rig moved to set up and drill additional wells.

The present system uses the support angles to removably tie numerous cylinders and blockouts together as needed.

Orifices may be disposed in a plurality of locations on the cylinders and on the blockouts to aid in fastening the components of the system together.

Thus has been broadly outlined the more important features of the improved oil and gas well pad foundation form system so that the detailed description thereof that follows may be better understood and in order that the present contribution to the art may be better appreciated.

An object of the oil and gas well pad foundation form system is to easily and quickly prepare for pad pouring on well sites.

Another object of the oil and gas well pad foundation form system is to be reusable.

A further object of the oil and gas well pad foundation form system is to provide for pipe connections to a well head.

An added object of the oil and gas well pad foundation form system is to prepare for simultaneous pad pours for numerous drilling efforts at the same location.

And, an object of the oil and gas well pad foundation form system is to be easily removed after pouring concrete.

These together with additional objects, features and advantages of the improved oil and gas well pad foundation form system will be readily apparent to those of ordinary skill in the art upon reading the following detailed description of presently preferred, but nonetheless illustrative, embodiments of the improved oil and gas well pad foundation form system when taken in conjunction with the accompanying drawings.

DETAILED DESCRIPTION OF THE DRAWINGS

With reference now to the drawings, and in particular FIGS. 1 through 6 thereof, the principles and concepts of the oil and gas well pad foundation form system generally designated by the reference number 10 will be described.

Figure 3:
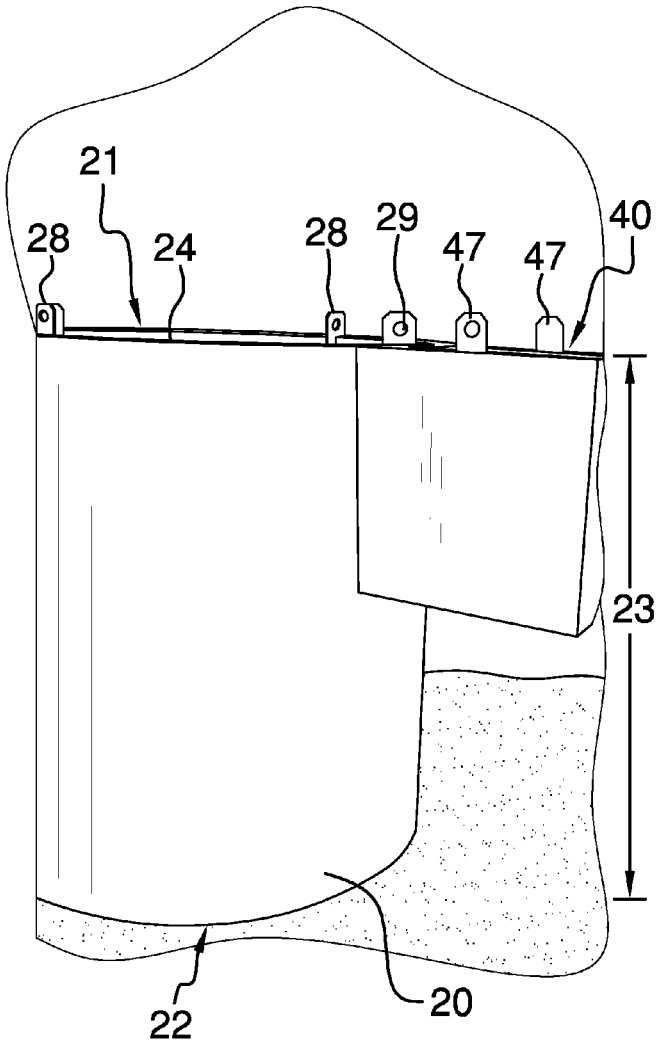
FIG. 3 is a lateral elevation view of one cylinder with disconnected first blockouts.

Referring to FIG. 3, the system 10 partially comprises a conical cylinder 20 having a height 23 of approximately 5 feet, a top diameter 21 of approximately 5 feet, and a bottom diameter 22 less than the top diameter 21.

Figure 1:
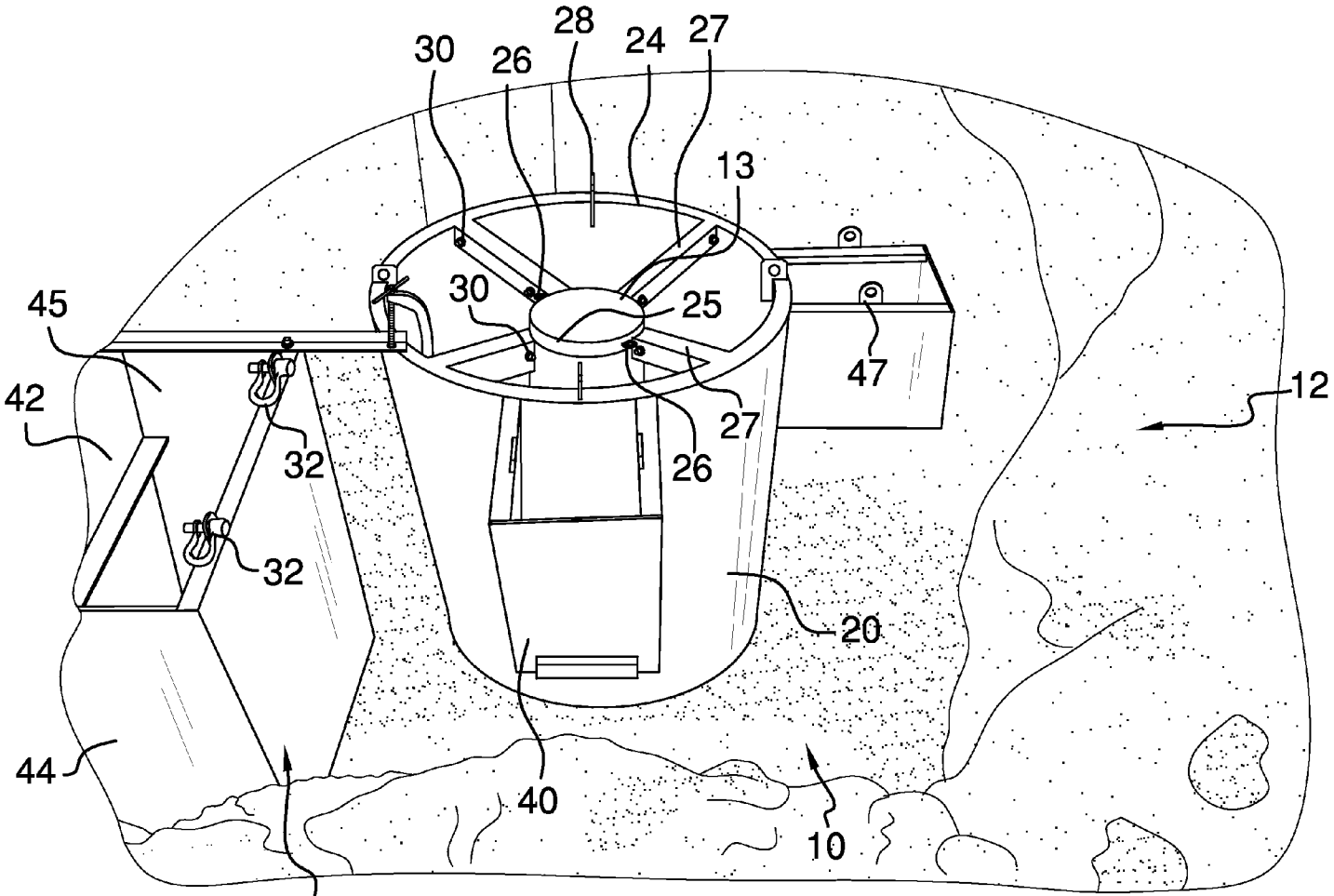
FIG. 1 is a perspective view of one cylinder with accompanying first blockouts and second blockout.

Referring to FIG. 1, the perimeter 24 is disposed horizontally inward within the cylinder 20 top diameter 21. The pair of selectively opened and closed center circles 25 is provided. One center circle 25 is disposed within the cylinder 20 adjacent to the top diameter 21. The other center circle 25 (not shown) is disposed within the cylinder 20 between the top diameter 21 and the bottom diameter 22. The cylinder circles 25 are removably disposed around the existing conductor 13 within the cellar 12 that awaits a concrete pour around the system 10. A plurality of spaced apart ears with holes 26 is disposed outwardly and horizontally from each center circle 25.

Figure 2:
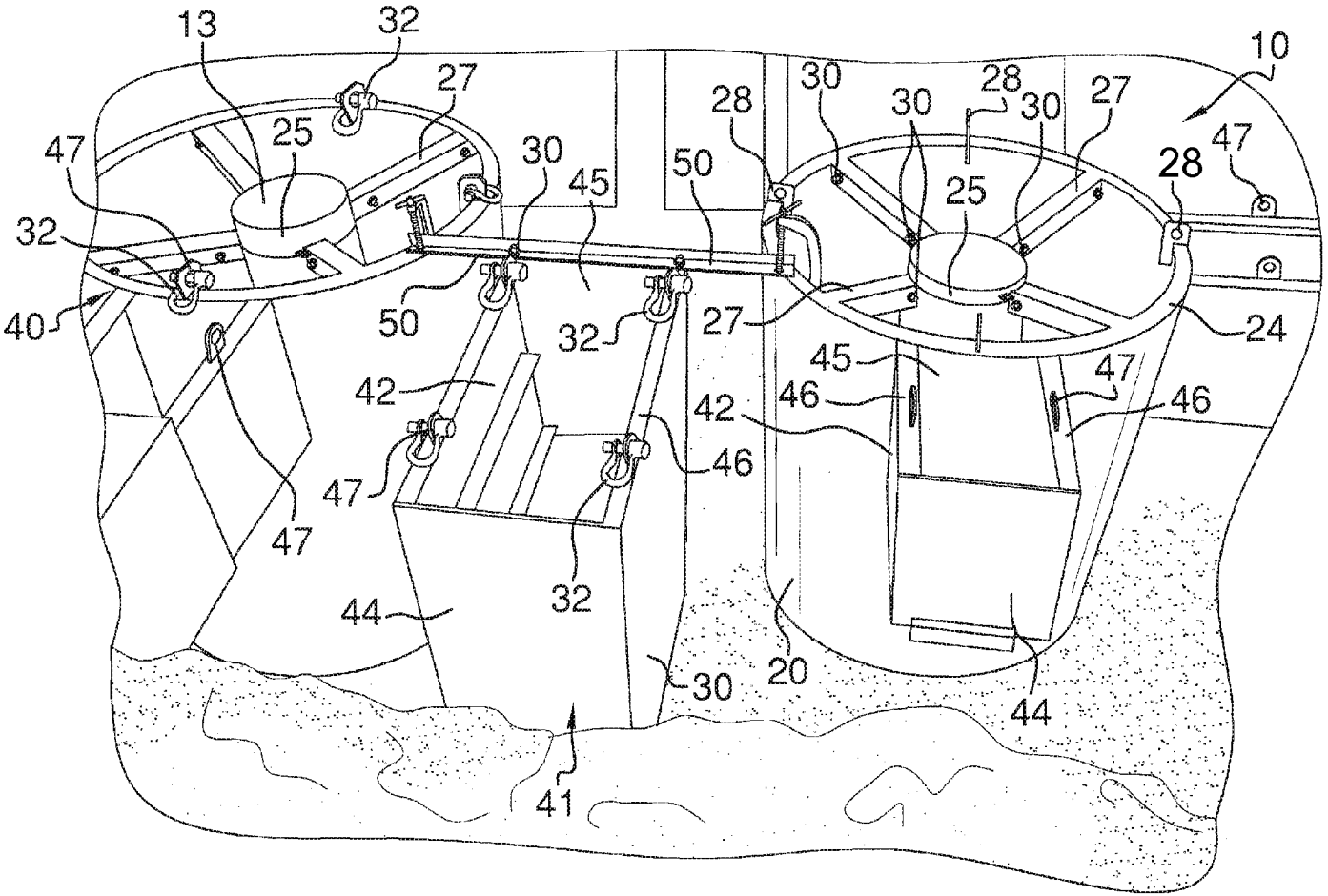
FIG. 2 is a perspective view of two cylinders joined by a support angle, each cylinder having attached first blockouts and a comingled second blockout.

Continuing to refer to FIGS. 1 and 2, a plurality of horizontal spaced apart radial braces 27 is fastened to each cylinder 20 via removable fasteners 30. One of each radial brace 27 is removably fastened to one of each of the cylinder 20 ears with holes 26. The center circles 25 are selectively and removably disposed around an existing conductor 13 in a cellar 12.

Figure 4:
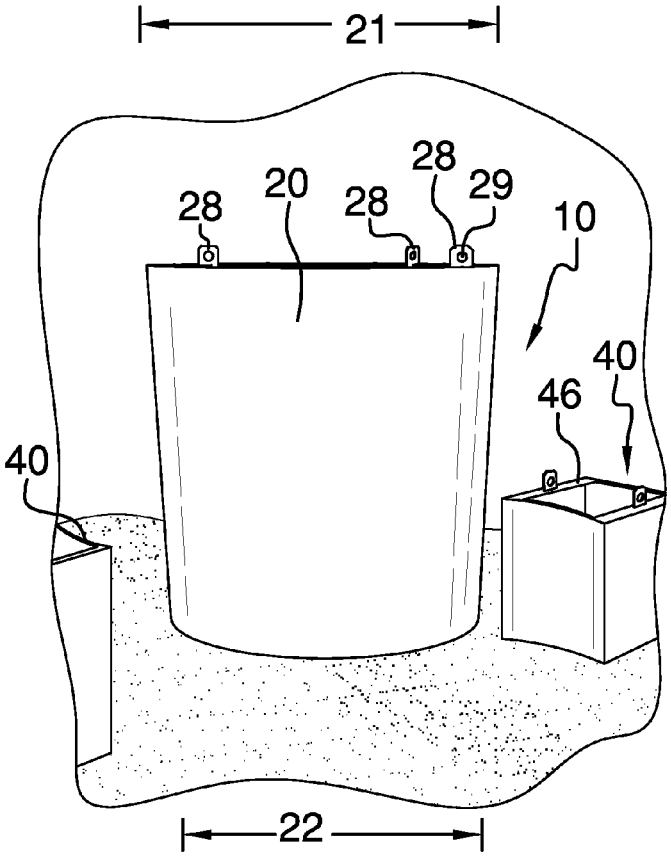
FIG. 4 is a lateral perspective view a cylinder with attached first blockout.

Referring to FIG. 4, a plurality of spaced apart cylinder lift brackets 28 is disposed upwardly from and interiorly around the cylinder 20 perimeter 24. An orifice 29 is disposed in each cylinder lift bracket 28.

Figure 6:
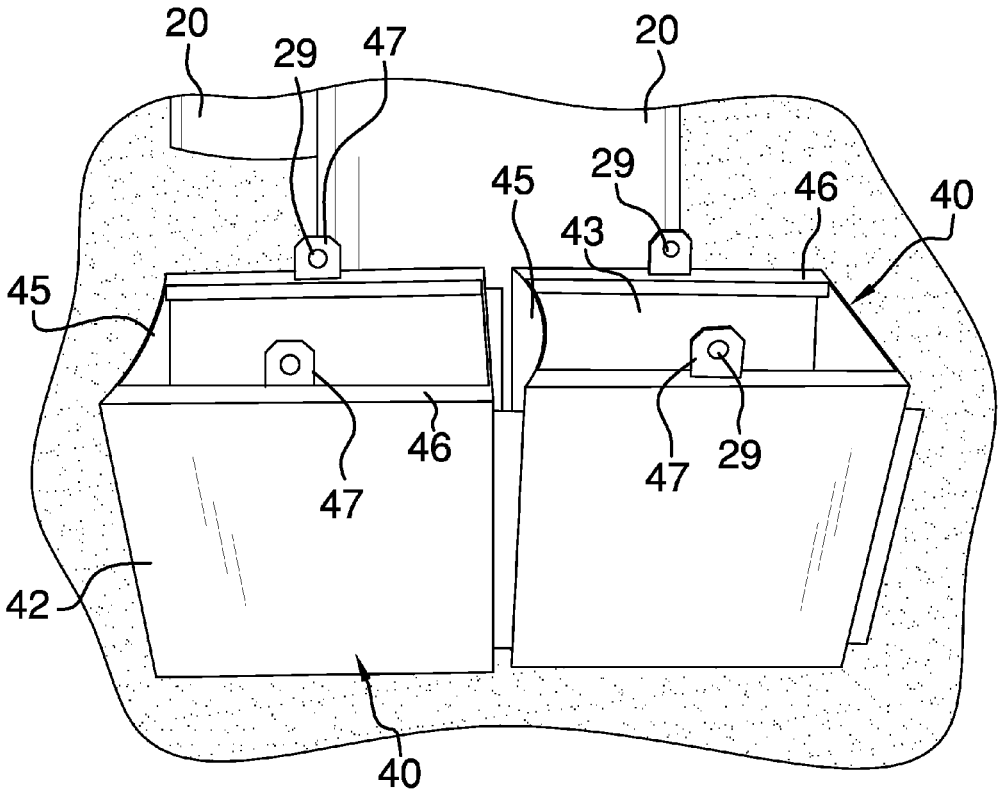
FIG. 6 is a perspective view of two first blockouts disconnected from a cylinder.

Referring to FIG. 6, a plurality of substantially rectangular first blockouts 40 is provided. Each first blockout 40 has a flat first side 42 spaced apart from a flat second side 43, and a flat third side 44 spaced apart from a concave fourth side 45.

Referring again to FIG. 2, a plurality of rectangular second blockouts 41 is provided. Each second blockout 41 has a flat first side 42 spaced apart from a flat second side 43, and a flat third side 44 spaced apart from a flat fourth side 45. A right angle inner lip 46 is disposed on the first side 42 and the second side 43 of each blockout. At least one blockout lift bracket 47 is disposed upwardly on each inner lip 46. An orifice 29 is disposed in each blockout lift bracket 47. A plurality of hanger bolts 32 is removably fitted to the lift brackets.

Figure 5:
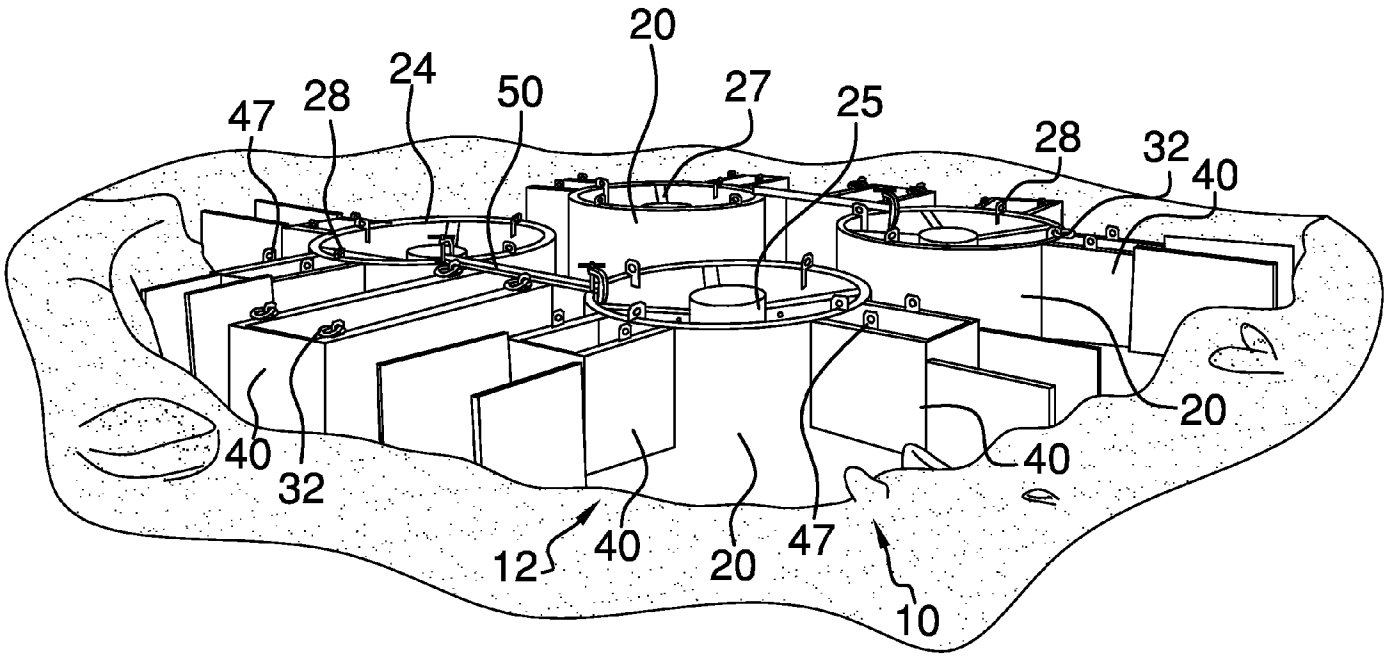
FIG. 5 is a perspective view of a quad installation of the system.

Referring to FIG. 5, an example of a quad arrangement for the system 10 illustrates the system's 10 ability to prepare for four wells simultaneously. Cylinders 20 may be temporarily joined with each other and with second blockouts 41, for example, by removable support angles 50. The system 10 has been lowered into the cellar 12 via the cylinder lift brackets 28 and the blockout lift brackets 47, with the cylinders 20 and blockouts removably fastened together by fasteners 30. The lift brackets are used to remove the system 10 once the concrete pour is completed. A release agent may be applied to the system 10 prior to pour to aid in removal.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the oil and gas well pad foundation form system may be used.

What is claimed is:

1. An oil and gas well pad foundation form system comprising, in combination:

a cylinder having a height of approximately 5 feet, a top diameter of approximately 5 feet;

a perimeter disposed horizontally inward within the cylinder top diameter;

a pair of selectively opened and closed center circles, one center circle disposed within the cylinder adjacent to the top diameter, one center circle disposed within the cylinder between the top diameter and the bottom diameter;

a plurality of spaced apart ears with holes disposed outwardly and horizontally from each center circle;

a plurality of horizontal spaced apart radial braces fastened to each cylinder via removable fasteners, one of each radial brace removably fastened to one of each of the cylinder ears with holes;

whereby the center circles are selectively and removably disposed around an existing conductor in a cellar;

a plurality of spaced apart cylinder lift brackets disposed upwardly from and interiorly around the cylinder perimeter;

an orifice disposed in each cylinder lift bracket;

a plurality of substantially rectangular first blockouts, each first blockout having a flat first side spaced apart from a flat second side, and a flat third side spaced apart from a concave fourth side;

a plurality of rectangular second blockouts, each second blockout having a flat first side spaced apart from a flat second side, and a flat third side spaced apart from a flat fourth side;

a right angle inner lip disposed on the first side and the second side of each blockout;

at least one blockout lift bracket disposed upwardly on each inner lip;

an orifice disposed in each blockout lift bracket;

a plurality of hanger bolts removably fitted to the lift brackets.

2. The system according to claim 1 wherein the center circle ears are further equidistantly spaced apart.

3. An oil and gas well pad foundation form system comprising, in combination:

a conical cylinder having a height of about 5 feet, a top diameter of about 5 feet, and a bottom diameter less than the top diameter;

a perimeter disposed horizontally inward within the cylinder top diameter;

a pair of selectively opened and closed center circles, one center circle disposed within the cylinder adjacent to the top diameter, one center circle disposed within the cylinder between the top diameter and the bottom diameter;

a plurality of equidistantly spaced apart ears with holes disposed outwardly and horizontally from each center circle;

a plurality of horizontal spaced apart radial braces fastened to each cylinder via removable fasteners, one of each radial brace removably fastened to one of each of the cylinder ears with holes;

whereby the center circles are selectively and removably disposed around an existing conductor in a cellar;

a plurality of spaced apart cylinder lift brackets disposed upwardly from and interiorly around the cylinder perimeter;

an orifice disposed in each cylinder lift bracket;

a plurality of substantially rectangular first blockouts, each first blockout having a flat first side spaced apart from a flat second side, and a flat third side spaced apart from a concave fourth side;

a plurality of rectangular second blockouts, each second blockout having a flat first side spaced apart from a flat second side, and a flat third side spaced apart from a flat fourth side;

a right angle inner lip disposed on the first side and the second side of each blockout;

at least one blockout lift bracket disposed upwardly on each inner lip;

an orifice disposed in each blockout lift bracket;

a plurality of hanger bolts removably fitted to the lift brackets.

* * * * *